United States Patent [19]

Kanda et al.

[11] 4,358,067

[45] Nov. 9, 1982

[54] METHOD OF PRODUCING PRESSURE-SENSITIVE COPYING SHEETS

[75] Inventors: Masao Kanda; Makoto Yoshida, both of Fujinomiya, Japan

[73] Assignee: Fuji Photo Film Co., Ltd., Kanagawa, Japan

[21] Appl. No.: 971,130

[22] Filed: Dec. 19, 1978

[30] Foreign Application Priority Data

Dec. 27, 1977 [JP] Japan ..... 52-159550

[51] Int. Cl.[3] ..... B65H 59/00

[52] U.S. Cl. ..... 242/75.51; 282/27.5; 427/150; 427/151; 427/179; 428/411; 428/913; 428/914; 428/320.6

[58] Field of Search ..... 427/150, 177, 151, 179; 428/307, 411, 913, 914; 282/27.5; 156/162; 162/119; 242/75.51

[56] References Cited

U.S. PATENT DOCUMENTS

| | | | |
|---|---|---|---|
| 2,800,457 | 7/1957 | Green et al. | 252/316 |
| 2,800,458 | 7/1957 | Green | 252/316 |
| 3,186,861 | 6/1965 | Smith et al. | 428/307 |
| 3,472,674 | 10/1969 | Kite | 428/307 |
| 3,526,528 | 9/1970 | Takahashi et al. | 427/358 |
| 3,535,140 | 10/1970 | Busch | 427/150 |
| 3,632,378 | 1/1972 | Busch | 427/150 |
| 3,767,451 | 10/1973 | Busch | 427/150 |
| 3,844,502 | 10/1974 | Toy | 242/75.51 |
| 3,936,573 | 2/1976 | Brockett | 427/150 |
| 3,955,026 | 5/1976 | Matsukawa et al. | 427/150 |
| 4,085,949 | 4/1978 | Asao et al. | 427/150 |

FOREIGN PATENT DOCUMENTS

| | | | |
|---|---|---|---|
| 952807 | 3/1964 | United Kingdom | 252/316 |
| 1046409 | 10/1966 | United Kingdom | 252/316 |
| 1330379 | 9/1973 | United Kingdom | 427/150 |

*Primary Examiner*—Sadie L. Childs

*Attorney, Agent, or Firm*—Sughrue, Mion, Zinn, Macpeak, and Seas

[57] ABSTRACT

A method for producing a pressure-sensitive copying sheet which comprises winding the pressure-sensitive copying sheet having a microcapsule coating film comprising microcapsules having an average particle size of 3–8 microns and a hydrophobic oil containing 3–6% by weight of a color former at 35 kg/m or less, and while winding continuously reducing the winding tension to an amount of about 40 to 70% of the initial winding tension as the roll diameter increases. An embodiment is also disclosed where said coating contains an antismudging and/or a covering agent and the initial winding tension is 70 kg/m or less.

10 Claims, 3 Drawing Figures

METHOD OF PRODUCING PRESSURE-SENSITIVE COPYING SHEETS

BACKGROUND OF THE INVENTION

1. Field of the Invention

The present invention relates to a method of producing pressure-sensitive copying sheets. In greater detail, it relates to a method of producing pressure sensitive copying sheets by which capsules composing the pressure-sensitive copying sheet are not broken.

2. Description of the Prior Art

Generally, as pressure-sensitive copying sheets, there are known: those comprising a layer of capsules containing a color former coated on one surface of a copying sheet, those comprising a layer of capsules containing a color former coated on one surface of a copying sheet and a layer of a color developer which brings about color development by adsorbing or reacting with said color former on the opposite side of the sheet; those in which layer of capsules containing a color former and a color developer is coated on one surface of the copying sheet, those comprising a multilayer structure of a layer of capsules containing a color former and a layer of a color developer coated on the same side of a copying sheet, and those having a layer of capsules containing a color former on the reverse side of said sheet. (Hereinafter, the term "pressure-sensitive copying sheet" refers to all of these materials.)

Pressure-sensitive copying sheets must possess the property that only in the area in which writing pressure is applied the color intensively and distinctly developed when the desired writing pressure is applied to the pressure-sensitive copying sheet. It has been clarified by Japanese Patent Publication No. 33204/73 corresponding to U.K. Pat. No. 1252858 and U.S. patent application Ser. No. 814,336 filed that the coloring ability of the pressure-sensitive copying sheet is represented by a typewriter intensive index (Ti) defined by the following equation.

$$Ti = \frac{\text{Reflectance of the coloring part}}{\text{Reflectance of the background}} \times 100$$

The lower the typewriter intensive index (Ti) is, the higher the coloring ability is.

On the other hand, the pressure-sensitive copying sheets must also have the property that the sheets are difficult to color during handling such that the capsules making up the sheets are not broken thereby. Japanese Patent Publication No. 33204/73 represents this property as a frictional stain intensive index (Fs) defined by the following equation.

$$Fs = \frac{\text{Reflectance of the staining area}}{\text{Reflectance of the background}} \times 100$$

The higher the frictional stain intensive index (Fs) is, the more difficult coloring is in general handling.

The preferred pressure-sensitive copying sheets must possess these two properties. Namely, a low Ti value and a high Fs value.

Particularly, it has recently been required that pressure-sensitive copying sheets be capable of bringing out color in high density with a lower mechanical impact pressure in order to satisfy the demands of high-speed line printers used in electronic computors. Pressure-sensitive recording sheets have also been required to be able to bring out color in high density with low writing pressure in order to make many copies at one time, since it is often necessary to make many copies at one time by pencil, etc.

In order to satisfy the above requirements and to decrease the Ti value, it is necessary to increase the concentration of the color former in the oil contained in the microcapsules in the pressure-sensitive copying sheet or to increase the particle size of the microcapsules or both. However, in such a case, the Fs value becomes low and the capsules break in general handling and stain the background. As a result, it is very difficult to obtain pressure-sensitive copying sheets which satisfy the above described requirements.

By the way, since the Fs value of the pressure-sensitive copying sheets is an indication of the difficulty of coloring in a case that the capsules are broken in handling to cause stains, it has been expected that the pressure-sensitive copying sheet causing less stain and having a low Ti value and a high coloring ability can be obtained even though the Fs value is low, if destruction of the capsules does not occur or occurs to a lesser extent in handling. However, since it has generally been believed that the degree of staining on the pressure-sensitive copying sheets depends on printing machines (see, for example, Japanese Patent Publication No. 33204/73), there is no room for accepting such a way of thinking, and, consequently, it has been believed that the pressure sensitive copying sheets causing less stain and having a high coloring ability are very difficult to produce.

SUMMARY OF THE INVENTION

An object of the present invention is to provide a method of producing pressure-sensitive copying sheets causing less stains and having a high coloring ability.

As the result of studies for attaining such an object, the present inventors have found that the occurrence of stains in pressure-sensitive copying sheets is observed chiefly in the production step prior to use, such as writing, etc. Particularly, the occurrence of stains is noted in the winding step when winding the sheet having a layer of capsules and a developer into a roll. Namely, it has been observed that, when winding tension is increased to prevent eccentricity when carrying out continuous winding of the pressure-sensitive copying sheet in a roll, the inside of the roll is compressed thereby causing winding compression as the roll diameter increases. Consequently, the capsules are broken by the excessive pressure causing stains on the pressure-sensitive copying sheets. On the other hand, when the winding tension is reduced in order to prevent occurrence of the excessive pressure, winding slip occurs as the roll diameter increases and the capsules are destroyed by meandering or slipping in the width direction. Furthermore, winding becomes difficult to carry out when there is winding slip which also causes stains to occur on the pressure-sensitive copying sheets. It has been clearly observed that the stains easily occur, particularly, on the part of the roll near the reel and that the stains occur further as the roll diameter increases.

As the result of earnest studies on the basis of such knowledge, it has been found that stains hardly occur on the pressure-sensitive copying sheets with sheets prepared by applying microcapsules having an average particle size of 3–8$\mu$ and containing 3–6% by weight of a color former in oil to a support and drying, if the winding tension at the minimum roll diameter at the start of winding is about 35 kg/m or less, generally 20 kg/m to 35 kg/m and the winding tension is gradually and continuously reduced to an amount of about 40 to 70% of the winding tension at the minimum roll diameter (i.e., initially) as the roll diameter increases. When the capsule coating has been treated with an antismudging and/or covering agent in a manner well known to those in the art, an initial winding tension of 70 kg/m or less is suitable.

Here, the term "winding tension" means the drawing force per unit of width which occurs in the longitudinal direction of the pressure-sensitive copying sheet when the sheet is wound into a roll.

DETAILED DESCRIPTION OF THE INVENTION

Figure 1:
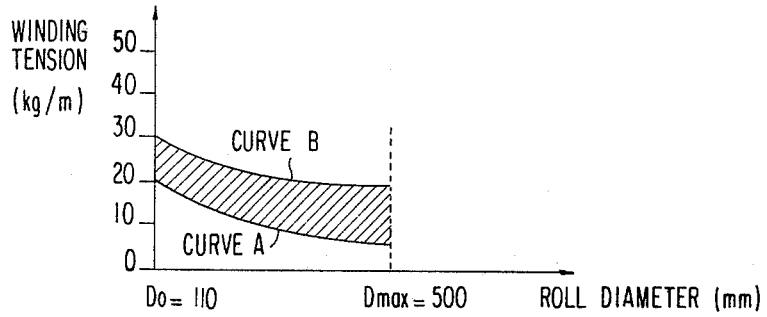
FIG. 1, FIG. 2 and FIG. 3 each show a range of winding operation at which occurrence of stains on the pressure-sensitive copying sheet can be prevented, wherein the A curves are obtained by plotting the upper limit values and the B curves are obtained by plotting the lower limit values.

FIG. 1 shows the range at which stains do not occur on a pressure-sensitive copying sheet prepared using capsules having an average particle size of 3 microns and containing 3% by weight of a color former dissolved in oil, when the pressure-sensitive copying sheet is wound by varying the winding tension. In the drawings, the axis of ordinate is the winding tension per meter of the roll width, the abscissa is the roll diameter, Do is the diameter of the reel, namely, the roll diameter at the start of the winding, and D max is the roll diameter at the end of the winding, namely, the maximum diameter of the roll. In the case of FIG. 1, Do = 110 mm and D max = 500 mm.

In FIG. 1, the curve A shows the relationship between the minimum winding tension at which the pressure-sensitive copying sheet can be wound in a roll without winding slip and the diameter of the roll, and curve B shows the relationship between the maximum winding tension, at which capsules in the above described pressure-sensitive copying sheet are hardly broken by winding compression and stains are not a problem for practical use and the diameter of the roll. Accordingly, if the winding tension in region C bounded by the curve A and the curve B is used and reduced continually for each roll diameter, occurrence of stains on the pressure-sensitive copying sheet can be prevented in the winding step. It is understood from FIG. 1 that it is necessary to gradually reduce the winding tension as the roll diameter increases, because curve A and curve B tend to gradually decrease against the increase in the roll diameter.

However, since winding compression easily occurs when the pressure-sensitive copying sheet is wound in a roll 50 to 60 cm in diameter, it is preferred to add an antismudging agent and/or a covering agent to the capsules in order to prevent the occurrence of stains near the reel.

Figure 2:
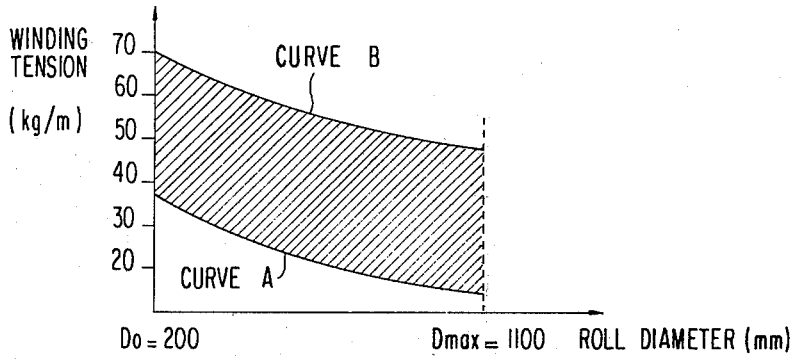

FIG. 2 shows a range at which stains do not occur on the pressure-sensitive copying sheet which is prepared by adding an antismudging agent and/or a covering agent to the capsules having an average particle size of 6μ and containing 4% by weight of a color former dissolved in oil, when the pressure-sensitive copying sheet is wound and the winding tension is continually reduced.

According to FIG. 2, it is recognized that the range of winding tension in which the pressure-sensitive copying sheet can be wound without the occurrence of stains expands remarkably as compared to FIG. 1 and, particularly, it is understood that it is possible for the roll diameter to increase 2 times or more.

Thus, it is possible to obtain a pressure-sensitive copying sheet causing less stains in the production and winding of the pressure-sensitive copying sheet even when the particle size of capsules is increased to improve the coloring ability, when the pressure-sensitive copying sheet is wound in a roll while reducing gradually the winding tension within a definite range as the diameter of the roll increases. Further, it becomes possible to expand the range of suitable winding tensions and to increase the roll diameter by adding the antismudging agent and/or the covering agent to the capsules, by which flexibility of the winding operation is enhanced.

Figure 3:
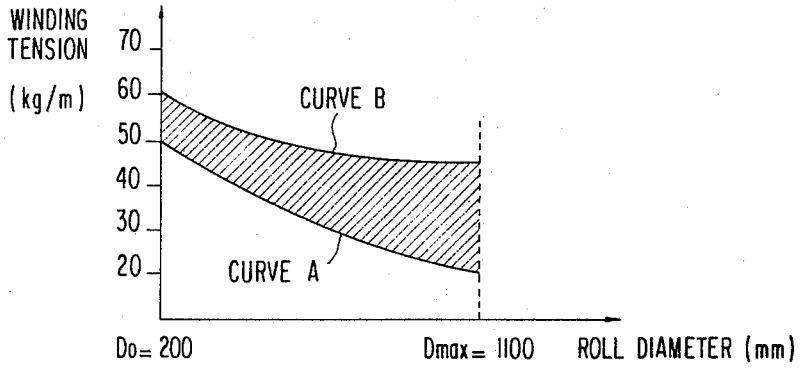

FIG. 3 shows a range of winding operation at which destruction of capsules by winding compression, winding crease or winding slip does not occur, when the concentration of the color former in oil is varied in a range of 3–6% by weight and the average particle size of the capsules is varied within a range of 3–8 microns as in FIG. 2.

In the present invention, the term "microcapsules" refers to fine capsules having an average particle size of 0.1–100μ comprising an oily solution containing a colorless color former dissolved or dispersed therein, the contents of which are covered with a membrane material composed of a high molecular weight material which is insoluble in both water and the oily solution. As the membrane materials, combinations of polycations and polyanions, such as gelatine-gum arabic and combinations of condensate compositions such as polyisocyanatepolyamine are conventionally used.

As a process for producing the microcapsules, there is a phase separation process using an aqueous solution as disclosed in U.S. Pat. Nos. 2,800,457 and 2,800,458, etc., an interfacial polymerization process as disclosed in Japanese Patent Publications 19574/63, 446/67, 771/67 (corresponding to U.K. Pat. No. 1,091,076), 2882/67, 2883/67, 8693/67, 9654/67 and 11344/67 and British Pat. Nos. 950,443 and 1,046,409, etc., a process comprising polymerizing a membrane material in oil drops as disclosed in Japanese Patent Publications 9168/61 and 45133/74, etc. or a process comprising melting, dispersing and cooling as disclosed in British Pat. Nos. 952,807 and 965,074, etc.

In the present invention, the color former is a material which has a property of forming color by donating electrons or accepting protons such as from acids, and the selection of the color former is not limited. Examples of these color formers include triarylmethane compounds such as 3,3-bis(p-dimethylaminophenyl)-6-dimethylaminophthalide, namely, Crystal Violet lactone, 3,3-bis-(p-dimethylaminophenyl)phthalide, 3-(p-dimethylaminophenyl)-3-(1,2-dimethylindol-3-yl)phthalide, 3-(p-dimethylaminophenyl)-3-(2-methylindol-3-yl)phthalide, 3-(p-dimethylaminophenyl)-3-(2-phenylindol-3-yl)phthalide, 3,3-bis-(1,2-dimethylindol-3-yl)-5-dimethylaminophthalide, 3,3-bis-(1,2-dimethylindol-3-yl)-6-dimethylaminophthalide, 3,3-bis-(9-ethylcarbazol-3-yl)-5-dimethylaminophthalide, 3,3-bis-(2-phenylindol-3-yl)-5-dimethylaminophthalide or 3-p-dimethylaminophenyl-3-(1-methylpyrrol-2-yl)-6-dimethylaminophthalide, etc.; diphenylmethane compounds such as 4,4'-bis-dimethylaminobenzhydrine benzyl ether, N-halophenyl-leuco Auramine or N-2,4,5-trichlorophenyl leuco Auramine, etc.; xanthene compounds such as Rhodamine B anilinolactam, Rhodamine B p-nitroanilinolactam, Rhodamine B p-chloroanilinolactam, 7-dimethylamino-2-methoxyfluoran, 7-diethylamino-2-methoxyfluoran, 7-dimethylamino-3-methoxyfluoran, 7-diethylamino-3-chlorofluoran, 7-diethylamino-3-chloro-2-methylfluoran, 7-diethylamino-2,2-dimethylfluoran, 7-diethylamino-3-acetylmethylaminofluoran, 7-diethylamino-3'-methylaminofluoran, 3,7-diethylaminofluoran, 7-diethylamino-3-dibenzylaminofluoran, 7-diethylamino-3-methylbenzylaminofluoran, 7-diethylamino-3-chloroethylmethylamino-fluoran or 7-diethylamino-3-diethylaminofluorane, etc.; thiazine compounds such as benzoyl leuco Methylene Blue or p-nitrobenzyl leuco Methylene Blue, etc.; spiro compounds such as 3-methyl-spiro-dinaphthopyran, 3-ethyl-spiro-dinaphthopyran, 3,3'-dichloro-spiro-dinaphthopyran, 3-benzyl-spiro-dinaphthopyran, 3-methylnaphtho-(3-methoxy-benzo)-spiro-pyran or 3-propyl-spiro-dibenzopyran, etc. and mixtures of them.

These color formers are dissolved or dispersed in a solvent to produce the capsules. As the solvent, natural oil or synthetic oil may be used alone or in admixture. Examples of the solvent include cotton seed oil, kerosene, paraffin, naphthene oil, alkylated biphenyl, alkylated terphenyl, chlorinated paraffin and alkylated naphthalene, etc.

The process for producing capsules has been described above.

In the present invention, the antismudging agent is a material which is comparatively elastic and exists as a solid in a coating film after drying. Examples of such are known in the art and are cellulose powder described in Japanese Patent Publication 1178/72 corresponding to U.K. Pat. No. 1,232,347, wheat starch, corn starch, potato starch, sweat potato starch, tapioca starch or rice starch or the like, oxidized starches obtained from these starches and an oxidizing agent, esterified starches such as acetyl starch, etherified starch, starch derivatives such as aldehyde starch, modified starch, cellulose fibers described in U.S. Pat. No. 2,711,375, microspheres described in Japanese Patent Application (OPI) 32013/73 (The term "OPI" as used herein refers to a "published unexamined Japanese patent application".), water soluble starch and binders described in Japanese Patent Application (OPI) No. 33204/73, arrowroot starch, banana starch or canna starch, etc.

Further, in the present invention, the covering agent is a material which forms a film which covers the capsule after drying. Examples are solutions of the various starches or starch derivatives described above as the antismudging agent, styrene-butadiene rubber latexes, styrene-butadiene-acrylonitrile latexes, or water soluble high molecular compounds such as protein (for example, gelatin, gum arabic and albumin, etc.), cellulose (for example, carboxymethylcellulose and hydroxyethylcellulose, etc.), saccharose (for example, agar, sodium alginate, starch and carboxymethyl starch, etc.) or polyvinyl alcohol, etc.

As a method of providing the microcapsule layer on the support in the present invention, though the so-called air-knife coating method has been well known (for example, U.S. Pat. Nos. 3,632,378, 3,503,567, 3,767,451, 3,705,049, 3,535,140, 3,472,674, 3,311,499 and 3,186,861 and British Pat. Nos. 1,336,800, 1,330,379, 1,176,469 and 1,161,934, etc.), it is of course possible to utilize other known coating methods, for example, a blade coating method (for example, Japanese Patent Publication No. 35330/74 corresponding to U.S. Pat. No. 3,897,578, etc.), a metalling bar coating method (for example, U.S. Pat. No. 3,897,578), a bead coating method (for example, U.S. Pat. No. 2,761,791), an extrusion coating method (for example, U.S. Pat. No. 3,526,528, etc.) or a curtain coating method (for example, Japanese Patent Publication Nos. 24133/74 corresponding to U.S. Pat. No. 3,508,947 and 35447/74 corresponding to U.S. Pat. No. 3,632,374, etc.).

In the present invention, the support upon which the capsule layer is provided includes not only generally used high-grade paper and middle grade paper but also regenerated paper, machine coated paper, art paper, cast coated paper, synthetic paper, resin coated paper and plastic films.

Generally, the microcapsules are applied in the amount of about 2.5 to 6 g/m$^2$ and preferably about 3.5 to 4.5 g/m$^2$ when preparing a microcapsule recording sheet. Such microcapsule sheets are usually employed in conjunction with a color developer coated on the same or an adjacent separate sheet in an amount of 3 to 8 g/m$^2$.

The following examples are provided in order to clarify the effect of the present invention and they are not to be construed as limiting the present invention. In the following examples, all parts, percents, ratios, etc. are by weight unless otherwise indicated.

EXAMPLE 1

5 parts of gelatin treated with acid from pig skin and 4 parts of gum arabic were dissolved in 350 parts of water at 40° C., and 45 parts of color former oil was emulsified in the resultant solution by adding 0.1 part of Turkey red oil as an emulsifying agent.

The color former oil was prepared by dissolving Crystal Violet lactone in oil consisting of 4 parts of diisopropylnaphthalene and 1 part of kerosene such that a 3% concentration of color former was obtained. Hot water of 40° C. was added to the emulsion to make 900 parts, and stirring was continued.

The temperature of the emulsion was held to 40° C. and the pH was adjusted to 4.5 by adding 10% acetic acid to cause coacervation.

After 20 minutes of stirring, the emulsion was allowed to cool to gelatinize the coacervate membranes deposited around the oil drops. When the temperature of liquid reached 20° C., 7 parts of 37% formaldehyde were added.

The emulsion was further cooled. When the temperature of the liquid reached 10° C., 40 parts of 7% carboxymethylcellulose sodium salt were added and a 15% aqueous solution of sodium hydroxide was then added dropwise slowly to adjust the pH to 9.

The temperature of liquid was elevated to 50° C. by heating with stirring. To the resultant capsule solution having capsules of an average particle size of 3$\mu$, water was added to make a capsule coating solution having 18% concentration.

The resulting capsule coating solution above described was applied at a rate of 70 m/min by an air knife coating method in an amount of 2.5 g/m$^2$ to the reverse side of a color developer sheet comprising high grade paper (40 g/m$^2$ of weight) of 800 mm width to which active white clay (Silton Clay produced by Mizusawa Kagaku Kygyo K.K.) which brought out the color by reacting with the color former in the capsule had been applied in an amount of 8 g/m$^2$. After drying, the copying sheet was wound on a paper reel having 75 mm of the diameter was begun at 30 kg/m of the winding tension. The winding tension was proportionately reduced as the roll diameter increased, i.e., a plot of winding tension vs. roll diameter is a straight line. When the roll diameter reached 500 mm and the winding tension reached 20 kg/m, winding was stopped.

When the wound roll was observed, a normally wound roll was obtained without the occurrence of winding compression, winding creases and winding slips.

When the wound roll was wound off, stains on the developer face were hardly observed. Further, when the resulted pressure-sensitive copying sheets were typed on with a typewriter as a superposed state, a sufficiently high color density was obtained.

EXAMPLE 2

Capsules having an average particle size of 4$\mu$ containing oil and having a color former concentration of 3% were obtained by the same manner as in Example 1 and a 18% capsule coating solution for pressure-sensitive copying was obtained.

The capsule coating solution produced by the above method was applied in the same manner and amount as in Example 1 and dried. The amount of active clay on the developer sheet was 3 g/m$^2$. Then, the copying sheet was wound on a metal cylindric core having a diameter of 200 mm. Winding was begun at 20 kg/m initial winding tension, and the winding tension was reduced as the roll diameter increased. When the roll diameter reached 300 mm and the winding tension reached 10 kg/m, the winding stopped.

When the wound roll was observed, a normally wound roll was obtained without the occurrence of winding compression, winding creases and winding slips.

When the wound roll was unwound, stains on the developer face were hardly observed. Further, when the resulting pressure-sensitive copying sheets were typed on with a typewriter in a superposed state, a sufficiently high color density was obtained.

EXAMPLE 3

Capsules having an average particle size of 3$\mu$ containing oil having a color former concentration of 4% were obtained by the same manner and in the same amount as in Example 1, and a 18% capsule coating solution for pressure-sensitive copying was obtained.

The resulting capsule coating solution was applied in the same manner as in Example 1 and dried. The amount of clay applied to the developer sheet was 5 g/m$^2$. Then, the copying sheet was wound on a metal cylindrical core having a diameter of 75 mm. The initial winding tension was 20 kg/m and the winding tension was reduced as the roll diameter increased. When the roll diameter reached 500 mm and the winding tension reached 8 kg/m, the winding was stopped.

When the wound roll was observed, a normally wound roll was obtained without the occurrence of winding compression, winding creases and winding slips.

When the wound roll was unwound, stains on the color developer face were hardly observed. Further, when the resulting pressure sensitive copying sheets were typed on with a typewriter in a superposed state, a sufficiently high color density was obtained.

On the other hand, in the above described example, the winding compression was observed when the sheet was wound with an initial winding tention of 80 kg/m and a final winding tension at a roll diameter was 500 mm of 60 kg/m.

Further, when the sheet was unwound, stains on the color developer face were observed near to the core from the circumference and, consequently, the sheet was of questionable practical use.

EXAMPLE 4

Capsules having an average particle size of 4$\mu$ containing oil having a color former concentration of 4% were obtained in the same manner and in the same amount as in Example 1, and a 18% capsule coating solution for pressure-sensitive copying was obtained.

The resulting capsule coating solution was applied in the same manner as in Example 1 to a developer sheet coated with Silton Clay in an amount of 3 g/m$^2$ and dried. Then, the copy sheet was wound on a metal cylindrical core having 200 mm of the diameter at an initial winding tension of 35 kg/m. The winding tension was reduced as the roll diameter increased. When the roll diameter reached 300 mm and the winding tension reached 15 kg/m, the winding was stopped.

When the wound roll was observed, a normally wound roll was obtained without the occurrence of winding compression, winding creases and winding slips.

When the wound roll was unwound, stains on the color developer face were hardly observed. Further, when the resulted pressure-sensitive copying sheets were typed on with a typewriter as a superposed state, a sufficiently high color density was obtained.

On the other hand, a wound roll of the pressure-sensitive sheet was also obtained by changing the final winding tension in the above described example to 5 kg/m.

The wound roll had an abnormal wound shape and serious winding slips were observed, by which creases resulted.

EXAMPLE 5

Capsules having an average particle size of 3$\mu$ containing oil having a color former concentration of 3% were obtained in the same manner as in Example 1 and applied in an amount of 3.5 g/m$^2$ to the reverse side of a color developer sheet coated with Silton Clay in an amount of 3 g/m$^2$. A cellulose powder was added as an antismudging agent in the amount of 5% based on the amount of color former oil and water was added thereto to adjust the concentration such that a 18% capsule coating solution for pressure-sensitive copying was obtained.

The resulting capsule coating solution was applied to a support at the rate of 200 m/min in the same manner as in Example 1 and dried. Then, the sheet was wound on a metal cylindrical core having a diameter of 200 mm at an initial winding tension of 40 kg/m. The winding tension was reduced as the roll diameter increased. When the roll diameter reached 600 mm and the winding tension reached 20 kg/m, the winding was stopped.

When the wound roll was observed, a normally wound roll was obtained without the occurrence of winding compression, winding creases and winding slips.

When the wound roll was unwound, stains on the color developer face were not observed. Further, when the resulting pressure-sensitive copying sheets were typed on with a typewriter as a superposed state, a sufficiently high color density was obtained.

On the other hand, a wound roll of the pressure-sensitive copying sheet was obtained with an initial winding tension of 90 kg/m and a final tension of 45 kg/m in the above described example.

The wound roll had a preferred shape in which winding compression, winding crease and winding slips were not observed. Stains on the color developer face were observed when the roll was unwound, though the part near the circumference of the roll had a good state without stains. Considerable stains were observed on the part near the core.

EXAMPLE 6

Capsules having an average particle size of 6μ containing oil having a color former concentration of 3% were obtained by the same process for producing capsules as in Example 1 and applied in an amount of 4 g/m$^2$ to the reverse side of a developer sheet coated with 5 g/m$^2$ of Silton Clay. Further, a cellulose powder was added as an antismudging agent in the amount of 7% based on the amount of color former oil, and thus a 18% capsule coating solution was obtained by adjusting the volume with water.

The capsule coating solution obtained above was applied to a support at a rate of 200 m/min in the same manner as in Example 1 and dried. Then, the sheet was wound on a metal cylindrical core having a diameter of 200 mm at an initial winding tension of 40 kg/m, and the winding tension was reduced as the roll diameter increased. When the roll diameter reached 300 mm and the winding tension reached 28 kg/m, the winding was stopped.

When the wound roll was observed, a normally wound roll was obtained without the occurrence of winding compression, winding creases and winding slips.

When the wound roll was unwound, stains on the color developer face were not observed. Further, when the resulting pressure-sensitive copying sheets were typed on with a typewriter in a superposed state, a sufficiently high color density was obtained.

On the other hand, a wound roll of the pressure-sensitive copying sheet was obtained with an initial winding tension of 40 kg/m and a final winding tension of 10 kg/m in the above described example.

The shape of the wound roll was not good. Loosening was observed and the circumference was particularly loose and winding creases were observed as well.

EXAMPLE 7

Capsules having an average particle size of 3μ containing oil having a color former concentration of 6% were obtained in the same process as in Example 1 and applied in an amount of 4 g/m$^2$ to the reverse side of a color developer sheet coated with 5 g/m$^2$ Silton Clay. Further, 7% of a cellulose powder was added as an antismudging agent and 2% of polyvinyl alcohol as a covering agent based on the amount of color former oil, and thus a 18% capsule coating solution was obtained by adjusting the volume with water.

The resulting capsule coating solution was applied to a support at a rate of 200 m/min in the same manner as in Example 1 and dried. Then, winding on a metal cylindrical core having a diameter of 200 mm was begun at 50 kg/m initial winding tension. The winding tension was reduced as the roll diameter increased. When the roll diameter reached 800 mm and the winding tension reached 35 kg/m, the winding was stopped.

When the wound roll was observed, a normally wound roll was obtained without the occurrence of winding compression, winding creases and winding slips.

When the wound roll was unwound, stains on the color developer face were hardly observed. Further, when the resulting pressure-sensitive copying sheets were typed on with a typewriter as a superposed state, a sufficiently high color density was obtained.

On the other hand, a wound roll of the pressure-sensitive copying sheet was obtained with an initial winding tension of 50 kg/m, which was maintained without reduction.

In the roll, winding compression was observed in the core part. When the roll was unwound, stains were observed on the entire color developer face of the sheet. Further, stains were observed on the color developer face corresponding to patterns of winding compression.

EXAMPLE 8

Capsules having an average particle size of 8μ containing oil having a color former concentration of 3% were obtained in the same process for producing capsules as in Example 1 and applied in an amount of 3 g/m$^2$ to the reverse side of a color developer sheet coated with 3 g/m$^2$ Silton Clay. Further, 8% of a cellulose powder was added as an antismudging agent and 4% of polyvinyl alcohol as a covering agent based on the amount of color former oil, and thus a 18% capsule coating solution was obtained upon adjusting the volume with water.

The capsule coating solution obtained by the above described method was applied in the same manner as in Example 1 and dried. Then, the sheet was wound on a metal cylindrical core having a diameter of 200 mm at an initial winding tension of 50 kg/m, and the winding tension was reduced as the roll diameter increased. When the roll diameter reached 900 mm and the winding tension reached 30 kg/m, the winding was stopped.

When the wound roll was observed, a normally wound roll was obtained without the occurrence of winding compression, winding creases and winding slips.

When the wound roll was unwound, stains on the developer face were not observed and the sheet had nearly the same whiteness as white paper. Further, when the resulted pressure-sensitive copying sheets were typed on with a typewriter in a superposed state, a sufficiently high color density was obtained.

EXAMPLE 9

Capsules having an average particle size of 6μ containing oil having a color former concentration of 5% were obtained by the same process for producing capsules as in Example 1 and applied in an amount of 4 g/m$^2$ to the reverse side of a developer sheet coated with 5 g/m$^2$ Silton Clay. Further, 8% of a cellulose powder was added to the emulsion as an antismudging agent and 4% of polyvinyl alcohol as a covering agent based on the amount of color former oil, and thus a 18% capsule coating solution was obtained upon adjusting the volume with water.

The capsule coating solution obtained was applied to a support in the same manner as in Example 1 and dried. Then, the sheet was wound on a metal cylindrical core having a diameter of 200 mm at an initial winding tension of 50 kg/m, and the winding tension was reduced as the roll diameter increased. When the roll diameter reached 900 mm and the winding tension reached 30 kg/m, the winding was stopped.

When the wound roll was observed, a normally wound roll was obtained without the occurrence of winding compression, winding creases and winding slips.

When the wound roll was unwound, stains on the color developer face were not observed, and the sheet having nearly the same whiteness as white paper was obtained. Further, when the resulted pressure-sensitive copying sheets were typed on with a typewriter in a superposed state, a sufficiently high color density was obtained.

On the other hand, a roll of the pressure-sensitive copying sheet was obtained with an initial winding tension of 50 kg/m and a final winding tension of 15 kg/m in the above described example.

When the shape of wound roll was observed, winding slips were observed in the roll at the middle part of the roll diameter. The sheet was not suitable for practical use.

EXAMPLE 10

Capsules having an average particle size of 4μ containing oil having a color former concentration of 4% were obtained in the same process for producing capsules as in Example 1, and a 18% capsule coating solution for pressure-sensitive copying was obtained upon adjusting the volume with water. This capsule coating was coated in an amount of 3.5 g/m$^2$ on a developer sheet coated with 6 g/m$^2$ Silton Clay.

The resulting capsule coating solution was applied at the rate of 70 m/min by the same manner as in Example 1 and dried. Then the sheet was wound on a paper core having a diameter of 75 mm at an initial winding tension of 30 kg/m, and the winding tension was reduced as the roll diameter increased. When the roll diameter reached 500 mm and the winding tension reached 20 kg/m, the winding was stopped.

When the wound roll was observed, a normally wound roll was obtained without the occurrence of winding compression, winding creases and winding slips.

When the wound roll was unwound, stains on the color developer face were not observed, and the sheet had the same whiteness as white paper. However, when the resulted pressure-sensitive copying sheets were typed on with a typewriter in a superposed state, the color density was insufficient and the sheet was unsuitable on practical use.

EXAMPLE 11

Capsules having an average particle size of 8μ containing oil having a color former concentration of 10% were obtained by the same process for producing capsules as in Example 1 and applied in an amount of 3 g/m$^2$ to the reverse side of a color developer sheet coated with 4 g/m$^2$ Silton Clay. Further, 8% cellulose powder was added as an antismudging agent and 4% of polyvinyl alcohol as a covering agent, based on the amount of color former oil, thus an 18% capsule coating solution for pressure-sensitive copying was obtained by adjusting the volume with water.

The resulting capsule coating solution was applied in the same manner as in Example 1 and dried. Then, the sheet was wound on a metal cylindrical core having a diameter of 200 mm at an initial winding tension of 50 kg/m, and the winding tension was reduced as the roll diameter increased. When the roll diameter reached 900 mm and the winding tension reached 30 kg/m, the winding was stopped.

When the wound roll was observed, a normally wound roll was obtained without the occurrence of winding compression, winding creases and winding slips.

When the developer face was observed by unwinding the roll, stains increased as the core was approached from the circumference of the roll, by which the sheet was unsuitable on practical use. But, when the resulting pressure-sensitive copying sheets were typed on with a typewriter in a superposed state, a sufficiently high color density was obtained.

EXAMPLE 12

Capsules having an average particle size of 1μ containing oil having a color former concentration of 5% were obtained by the same process for producing capsules as in Example 1 and applied in an amount of 5 g/m$^2$ to the reverse side of a developer sheet coating with 5 g/m$^2$ Silton Clay. Further, 7% of a cellulose powder was added as an antismudging agent based on the amount of color former oil, thus an 18% capsule coating solution for pressure-sensitive copying was obtained upon adjusting the volume with water.

The resulting capsule coating solution was applied to a support at the rate of 70 m/min in the same manner as in Example 1 and dried. Then, the sheet was wound on a metal cylindrical core having a diameter of 200 mm at an initial winding tension of 50 kg/m, and the winding tension was reduced as the roll diameter increased. When the roll diameter reached 900 mm and the winding tension reached 30 kg/m, the winding was stopped.

When the wound roll was observed, a normally wound roll was obtained without the occurrence of winding compression, winding creases and winding slips.

When the wound roll was unwound, stains on the color developer face were not observed. However, when the resulting pressure-sensitive copying sheets were typed on with a typewriter in a superposed state, they were unsuitable for practical use because they had an inferior color forming ability.

EXAMPLE 13

Capsules having an average particle size of 12μ containing oil having a color former concentration of 6% were obtained by the same process for producing capsules as in Example 1 and coated in an amount of 2.5 g/m$^2$ on the reverse side of a developer sheet coated with 3 g/m$^2$ Silton Clay. Further, 8% of a cellulose powder was added as an antismudging agent and 4% of polyvinyl alcohol as a covering agent, based on the amount of color former oil, thus an 18% capsule coating solution for pressure-sensitive copying was obtained upon adjusting the volume with water.

The resulting capsule coating solution was applied to a support at the rate of 200 m/min in the same manner as in Example 1 and dried. Then, the sheet was wound on a metal cylindrical core having a diameter of 200 mm at an initial winding tension of 50 kg/m, and the winding tension was reduced as the roll diameter increased. When the roll diameter reached 900 mm and the winding tension reached 30 kg/m, the winding was stopped.

When the wound roll was observed, a normally wound roll was obtained without the occurrence of winding compression, winding creases and winding slips.

When the pressure-sensitive copying sheets which resulted upon unwinding the roll were typed on with a typewriter in a superposed state, and though a sufficiently high color density was obtained, stains were observed on the developer face. Particularly, the stains increased as the core portion was approached.

While the invention has been described in detail and with reference to specific embodiments thereof, it will be apparent to one skilled in the art that various changes and modifications can be made therein without departing from the spirit and scope thereof.

What is claimed is:

1. A method of producing pressure-sensitive copying sheets which comprises winding a pressure-sensitive copying sheet having a microcapsule coating comprising microcapsules which have an average particle size of 3 to 8 microns and which contain a hydrophobic oil containing 3–6% by weight of a color former at an initial winding tension of 35 kg/m or less at the minimum roll diameter and, while winding, continuously reducing the winding tension to an amount of about 40 to 70% of the initial winding tension at said minimum roll diameter as the diameter of the roll increases.

2. A method of producing pressure-sensitive copying sheets which comprises winding a pressure-sensitive copying sheet having a microcapsule coating comprising microcapsules which have an average particle size of 3–8 microns and which contain a hydrophobic oil containing 3–6% by weight of a color former, an antismudging agent and/or a covering agent at an initial winding tension of 70 kg/m or less at the minimum roll diameter, and, while winding, continuously reducing the winding tension to about 40–70% of the initial winding tension at said minimum roll diameter as the roll diameter increases.

3. The method of claim 1 or 2, wherein said winding tension is reduced continuously in proportion to the roll diameter.

4. The method of claim 1 or 2, wherein said winding tension is reduced stepwise in amounts proportional to the roll diameter.

5. The method of claim 1 or 2, wherein the minimum initial winding tension is 20 kg/m.

6. The method of claim 1 or 2, wherein said microcapsules are coated on said copying sheet in an amount of about 2.5 to 6 g/m$^2$.

7. The method of claim 2, wherein said antismudging agent is a material which is comparatively elastic and exists as a solid in a coating film after drying.

8. The method of claim 7, wherein said antismudging agent is cellulose powder, wheat starch, corn starch, potato starch, sweet potato starch, tapioca starch or rice starch, oxidized starches thereof, esterified starches, etherified starches, aldehyde starches, modified starches, cellulose fibers, microspheres, arrowroot starch, banana starch or canna starch.

9. The method of claim 2, wherein said covering agent is a material which forms a film which covers the capsule after drying.

10. The method of claim 9, wherein said covering agent is a wheat starch solution, a corn starch solution, a potato starch solution, a sweet potato starch solution, a tapioca starch solution, a rice starch solution, solutions of oxidized starches thereof, a solution of an esterified starch, a solution of an etherified starch, a solution of an aldehyde starch, styrenebutadiene rubber latexes, styrene-butadiene-acrylontrile latexes, gelatin, gum arabic, albumin, carboxymethylcellulose, hydroxyethylcellulose, agar, sodium alginate, starch, carboxymethyl starch, or polyvinyl alcohol.

* * * * *